US008253074B2

(12) United States Patent
Watkins et al.

(10) Patent No.: US 8,253,074 B2
(45) Date of Patent: Aug. 28, 2012

(54) WIRING ASSEMBLY FOR AN APPLIANCE

(75) Inventors: Derek Lee Watkins, Elizabethtown, KY (US); John Mark Chilton, Campbellsburg, KY (US); Steve B. Froalicher, Shepherdsville, KY (US); Jay Andrew Broniak, Louisville, KY (US); Michael Paul McGonagle, Louisville, KY (US)

(73) Assignee: General Electric Company, Schenectady, NY (US)

( * ) Notice: Subject to any disclaimer, the term of this patent is extended or adjusted under 35 U.S.C. 154(b) by 934 days.

(21) Appl. No.: 12/329,555

(22) Filed: Dec. 6, 2008

(65) Prior Publication Data

US 2010/0140247 A1 Jun. 10, 2010

(51) Int. Cl.
*F24C 15/02* (2006.01)
*H05B 1/02* (2006.01)

(52) U.S. Cl. ..... 219/391; 219/702; 219/722; 126/273 R

(58) Field of Classification Search ..... None
See application file for complete search history.

(56) References Cited

U.S. PATENT DOCUMENTS

| | | | | |
|---|---|---|---|---|
| 4,255,640 | A | 3/1981 | Bressler | |
| 6,300,609 | B1 | 10/2001 | Kim | |
| 6,575,760 | B2 * | 6/2003 | Doshita et al. | 439/34 |
| 6,811,404 | B2 * | 11/2004 | Doshita et al. | 439/34 |
| 6,984,811 | B2 | 1/2006 | Lee | |
| 2002/0005014 | A1 * | 1/2002 | Doshita et al. | 49/360 |
| 2003/0168447 | A1 | 9/2003 | Lee | |
| 2003/0184119 | A1 * | 10/2003 | Doshita et al. | 296/155 |
| 2006/0219711 | A1 * | 10/2006 | Ide | 219/723 |

FOREIGN PATENT DOCUMENTS

| | | | |
|---|---|---|---|
| WO | WO03/077601 | A | 9/2003 |
| WO | WO2006/021936 | A1 | 3/2006 |
| WO | WO2008/032903 | A1 | 3/2008 |

* cited by examiner

*Primary Examiner* — Joseph M Pelham

(74) *Attorney, Agent, or Firm* — Global Patent Operation; Douglas D. Zhang

(57) ABSTRACT

A wiring assembly for an appliance is disclosed. The appliance has a main body and a door movably attached to the main body. The wiring assembly includes a base attachable to the door and having a first end and a second end; a slide slidably mounted on the base so that the slide is moveable between a first position where the slide is adjacent to the first end and a second position where the slide is adjacent to the second end; a tensioning or biasing member engaging the slide with the base and biasing the slide to the first position; and a cable assembly including a power/communication cable attachable to the main body and connected to the slide. An appliance incorporating such a wiring assembly is also disclosed.

20 Claims, 7 Drawing Sheets

WIRING ASSEMBLY FOR AN APPLIANCE

BACKGROUND OF THE INVENTION

The present invention relates generally to a wiring assembly for an appliance. More particularly, the present invention relates to a wiring assembly that allows wiring, such as for example power and communication wiring, to have a translating motion with a door on an appliance as the door pivots open. The present invention is especially useful in doors having complex motions, such as for example doors that have a four-bar hinge.

Household appliances, such as ovens, often have an access door that is connected to the main body via an articulating hinge, such as a four-bar hinge. When such a door is opened, it translates away from the main body and pivots open in a compound fashion. The articulating four-bar hinges used in this regard create complex motions that are not accommodated by conventional wiring techniques employed with non-articulating access doors which involve single point bending of the wiring linking the access door and the main body. This is especially problematic if one wishes to locate a Human Machine Interface (HMI), such as a control panel, in the access door itself.

BRIEF DESCRIPTION OF THE INVENTION

One aspect of the present invention relates to a wiring assembly for an appliance having a main body and a door movably attached to the main body. The wiring assembly includes a base attachable to the door and having a first end and a second end; a slide slidably mounted on the base so that the slide is moveable between a first position where the slide is adjacent to the first end and a second position where the slide is adjacent to the second end; a tensioning or biasing member engaging the slide with the base and biasing the slide to the first position; and a cable assembly including a power/communication cable attachable to the main body and connected to the slide.

Another aspect of the present invention relates to a wiring assembly for an appliance having a main body and a door movably attached to the main body by a hinge. The wiring assembly includes a slide assembly including a base having a first end and a second end, the base being attached to the door; a slide slidably mounted on the base so that the slide is moveable between a first position where the slide is adjacent to the first end and a second position where the slide is adjacent to the second end, the slide including a first circuit board; and a tensioning or biasing member engaging the base with the slide and biasing the slide to the first position. The wiring assembly also includes a cable assembly including a first power/communication cable attached to the main body and operatively connected to the first circuit board.

Yet another aspect of the invention relates to an appliance including a main body defining a cavity therein; a door movably attached to the main body by an articulating hinge for selectively covering the cavity, the door being pivotable about an edge thereof; a Human Machine Interface disposed in the door; a slide assembly including a base having a first end and a second end, the base being attached to the door so that the second end is closer to the edge of the door than the first end, a slide slidably mounted on the base so that the slide is moveable between a first position where the slide is adjacent to the first end and a second position where the slide is adjacent to the second end, the slide including a first circuit board operatively connected to the Human Machine Interface, and a tensioning or biasing member engaging the base with the slide and biasing the slide to the first position; and a cable assembly including a first power/communication cable attached to the main body and operatively connected to the first circuit board.

Yet still another aspect of the invention relates to an appliance including a main body defining a cavity therein; a door for selectively covering the cavity, the door being movably attached to the main body by an articulating hinge arrangement so that the door is movable between a closed position and an open position; a Human Machine Interface disposed in the door; a slide assembly including a base fixedly attached to the door, and a slide slidably mounted on the base for movement between a first position relatively close to the Human Machine Interface and relatively remote from the hinged edge of the door, and a second position relatively remote from the Human Machine Interface and relatively close to the hinged edge of the door; a biasing member biasing the slide to the first position; a cable assembly including a first power/communication cable, and a second power/communication cable; and a cable connector carried by the slide. The first power/communication cable has a first end attached to the main body and a second end operatively connected to the cable connector and the second power/communication cable having a first end operatively connected to the cable connector and a second end operatively connected to the Human Machine Interface, the second ends of the first and second power/communication cables being operatively connected to each other by the cable connector. The first power/communication cable is operative to move the slide from the first position to the second position as the door moves from the closed position to the open position.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE EXEMPLARY EMBODIMENTS OF THE INVENTION

Figure 1:
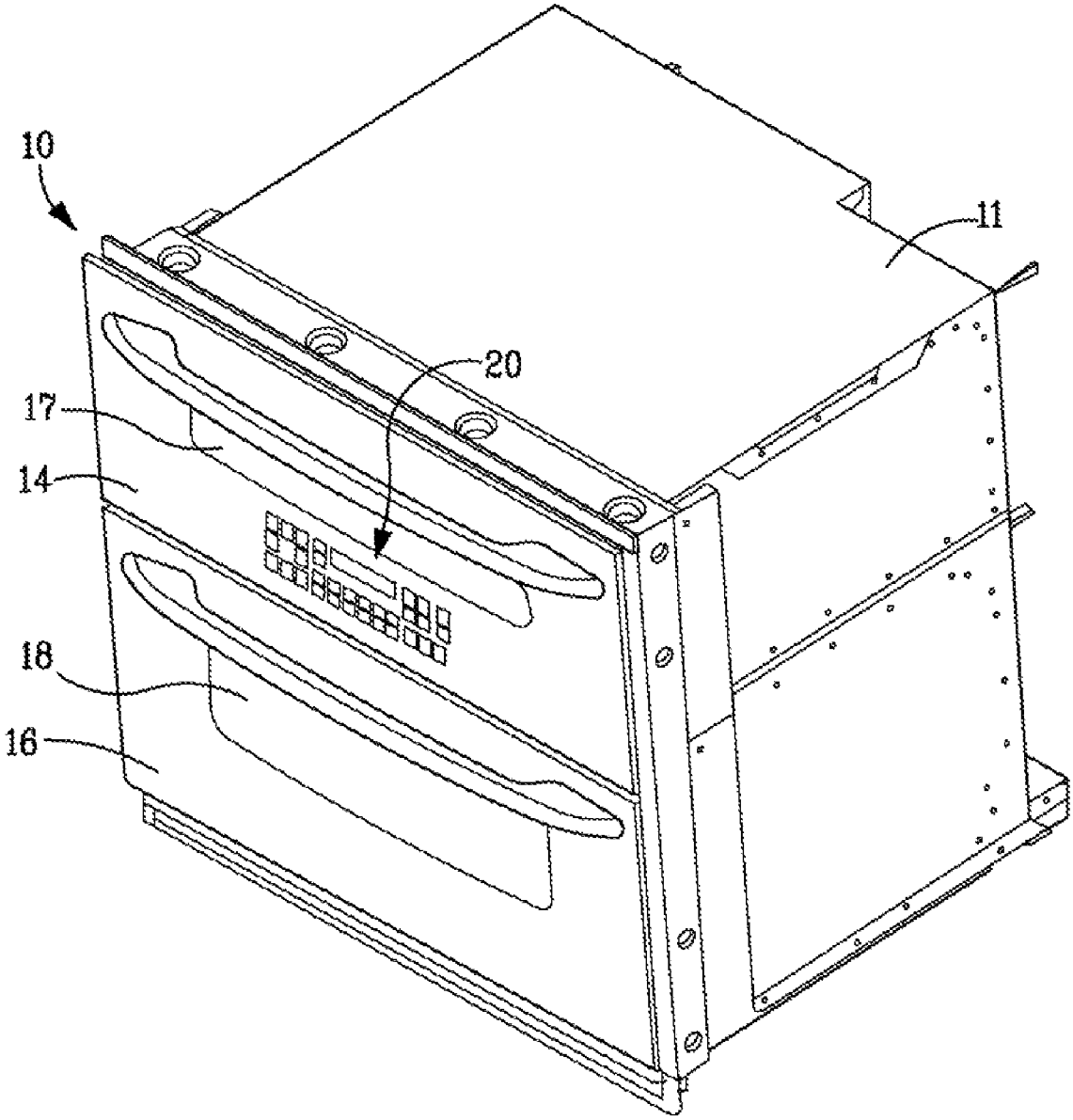
FIG. 1 is a perspective view of an exemplary appliance incorporating a wiring assembly in accordance with an embodiment of the present invention.

FIG. 1 illustrates an exemplary appliance 10 incorporating a wiring assembly in accordance with an exemplary embodiment of the invention. By way of example only, the exemplary appliance 10 is shown as a double-cavity wall oven. However, the exemplary embodiments described herein can be used in other types of appliances including, but not limited to, single-cavity wall ovens, free standing ranges, microwave ovens.

Figure 2:
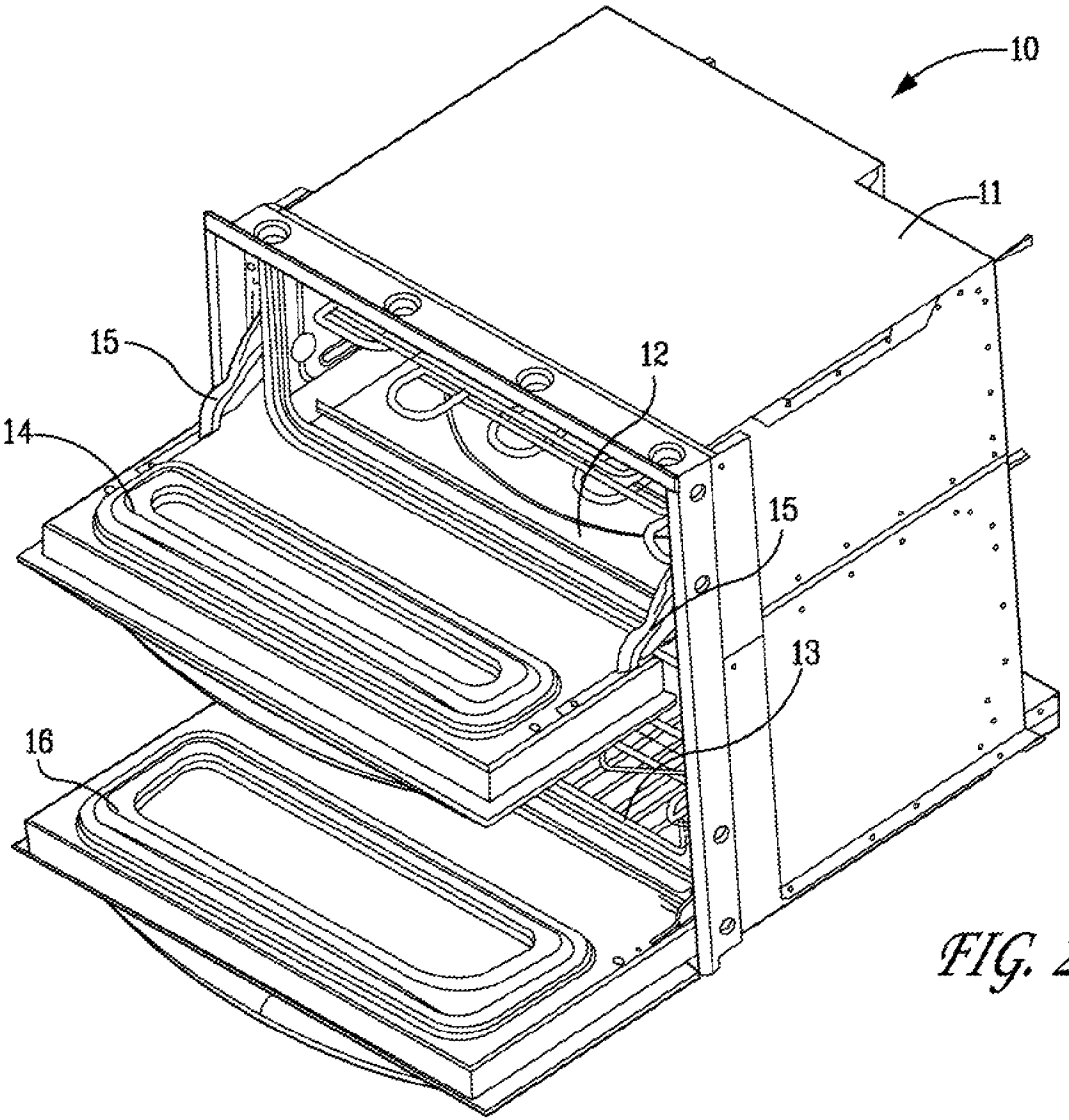
FIG. 2 is another perspective view of the appliance of FIG. 1, showing the access doors are in open positions.
Figure 3:
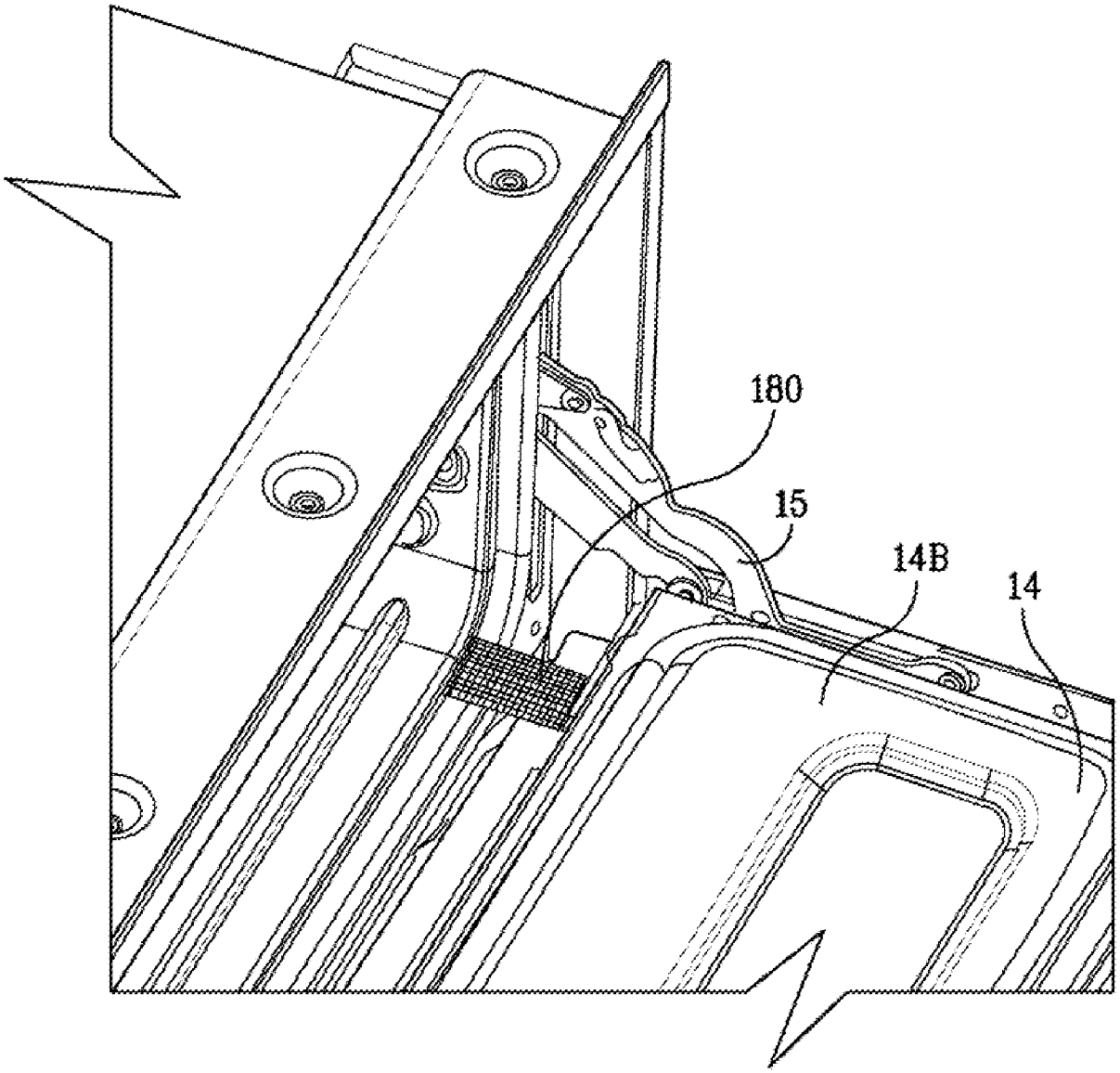
FIG. 3 is an enlarged, partial, perspective view of the appliance of FIG. 1, showing a four-part articulated hinge, the related access door, and part of the wiring assembly.

Referring to FIGS. 1 and 2, the appliance 10 has a main body or frame 11 that defines an upper oven cavity or chamber 12, and a lower oven cavity or chamber 13 therein. The appliance 10 also has an upper access door 14, which is movably attached to the main body 11 by a pair of hinges 15 to selectively cover the frontal opening of the upper oven cavity 12. The upper access door 14 has a window 17. As illustrated in FIG. 3, each of the hinges 15 is a four-bar articulated hinge which both translates and pivots the door away from the frame 11. Four-bar hinges are known in the art, and therefore will not be discussed in detail here. A lower access door 16 can be movably attached to the main body 11 in a similar fashion to selectively cover the frontal opening of the lower oven cavity 13. The lower access door 16 has a window 18. Heating elements are provided in the upper and lower oven cavities in a conventional manner.

As discussed earlier, it is desirable to integrate an HMI 20 into one or both of the access doors 14, 16 (FIG. 1 shows the HMI 20 is in the access door 14). The HMI 20 provides the interface between a consumer and the mechanical, electronic or electromechanical control of the oven 10. The HMI 20 typically includes input and output components for consumer interfacing and feedback via one or more display components. Without limitation, input components for the HMI 20 can include keys, knobs, glass touch keys (e.g., glass capacitive touch technology or field-effect switch technology), switches integrated into a membrane that can be adhered to the access door, tactile buttons that can be integrated into the access door, or knobs that can traverse through the access door. Without limitation, display components for the HMI 20 can include displays employing light emitting diodes (LEDs), vacuum fluorescent displays (VFDs), or liquid crystal displays (LCDs). The HMI 20 depicted in FIG. 1 can employ one or more of the elements described herein.

Figure 4B:
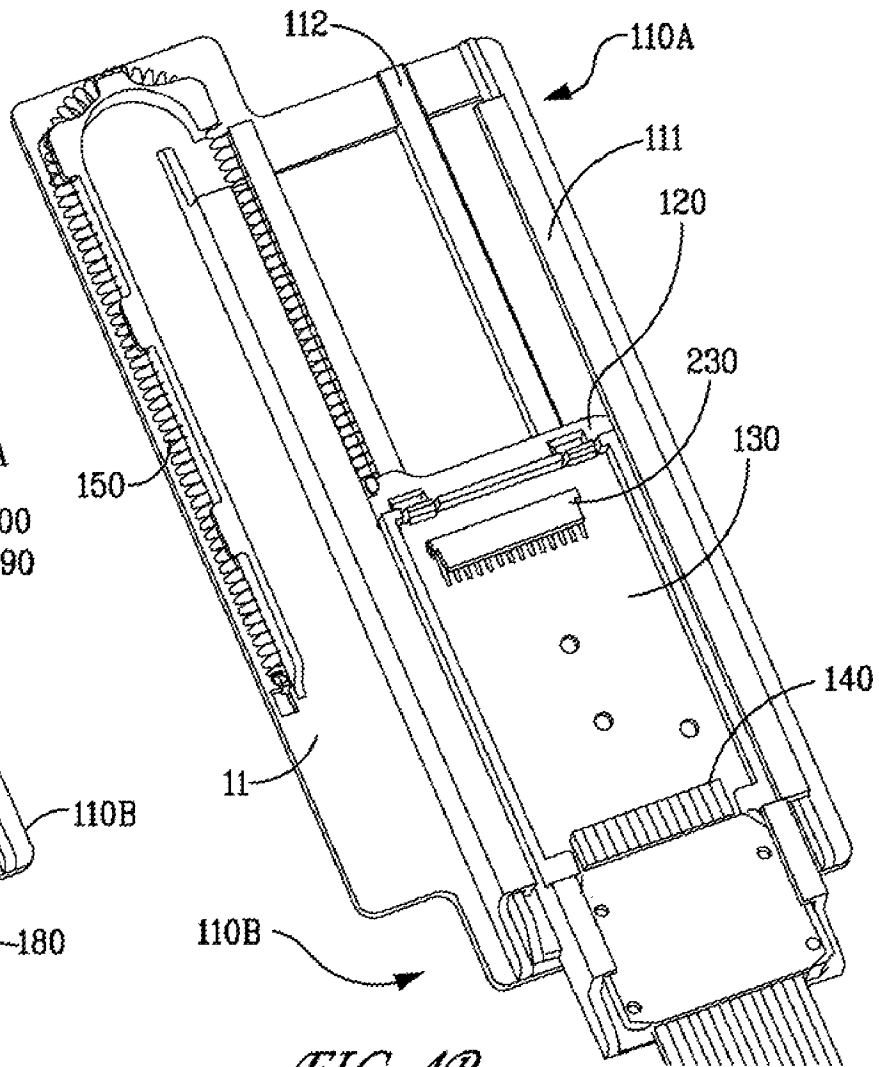
FIG. 4B is a perspective view of the wiring assembly of FIG. 3, showing the position of the slide relative to the base when the related access door is in an open position.
Figure 4A:
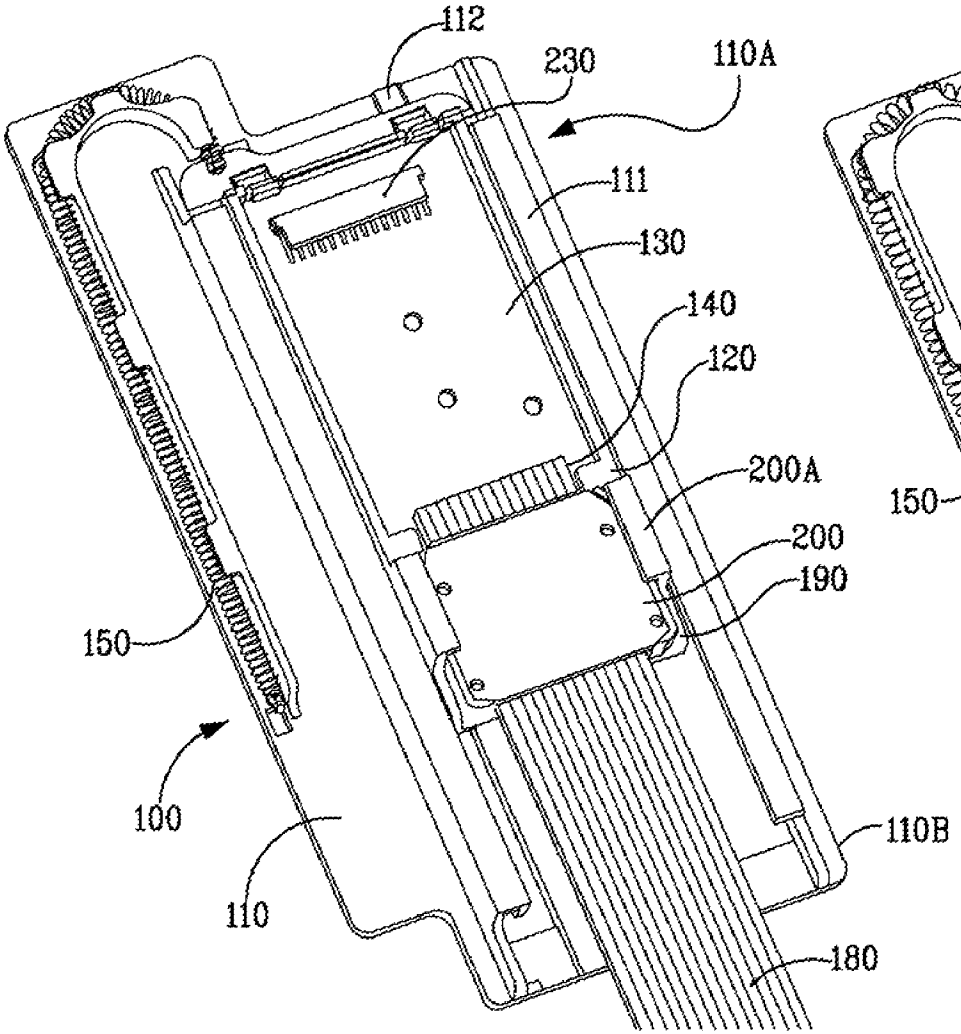
FIG. 4A is a perspective view of the wiring assembly of FIG. 3, showing the position of the slide relative to the base when the related access door is in a closed position.
Figure 5B:
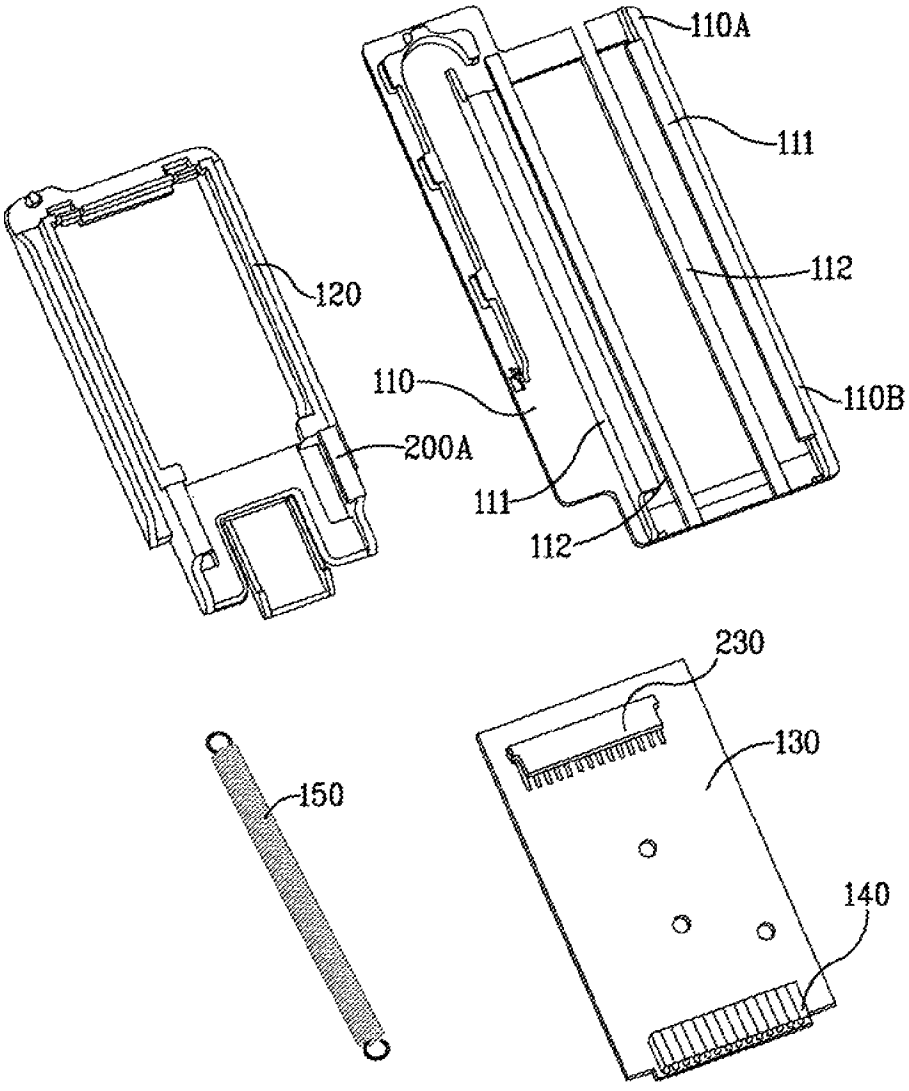
FIGS. 5A and 5B are perspective views, showing the elements of the slide assembly of the wiring assembly of FIG. 3 in assembled and unassembled stages.
Figure 5A:
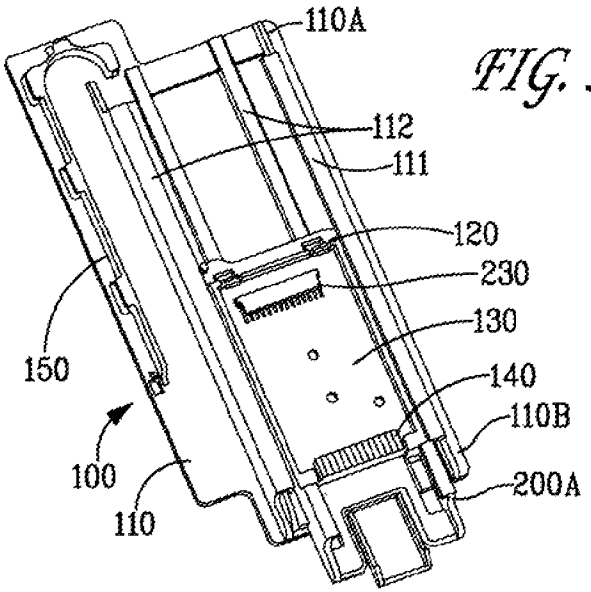

Referring now to FIGS. 3, 4A, 4B, 5A and 5B, a wiring assembly 100 in accordance with an exemplary embodiment of the present invention is used to establish a connection between the HMI 20 and electrical components mounted in the main body, e.g., relays or other switching devices (not shown) for controlling energization of heating elements or lamps (not shown) for illuminating the interior of the oven cavities, or temperature sensors monitoring the temperature in the cavities for each of the ovens. The wiring assembly 100 includes a slide assembly which includes a base 110 and a slide 120. The access door 14 preferably includes an outer panel 14A (see FIG. 7), and an inner panel 14B (see FIG. 3) which is spaced apart from the outer panel 14A. The base 110 has a first end 110A, and an opposite second end 110B. In the exemplary embodiment, the base 110 is fixedly mounted to the inner surface of the outer panel 14A with the second end 110B being closer to the bottom edge of the access door 14 than the first end 110A. The base 110 also has a pair of side guides 111 and a pair of middle guides 112. The side guides 111 are on a plane which is off set from the plane defined by the middle guides 112 so that the slide 120 can be retained by, and be movable relative to the base 110 along these guides 111, 112 between a first position where the slide 120 is adjacent to the first end 110A (FIG. 4A) and a second position where the slide 120 is adjacent to the second end 110B (FIG. 4B). A tensioning member 150 is operatively coupled between the slide 120 with the base 110. In the exemplary embodiment, the tensioning member 150 is a spring, but other tensioning devices could be similarly employed. The tensioning member 150 is configured to bias the slide 120 toward its first position, as shown in FIG. 4A. The slide 120 carries a cable connector for operatively coupling the power/communication cable which is linked to the main body to the power/communication cable which is linked to the HMI 20 as hereinafter described. In the exemplary embodiment, the cable connector comprises a circuit board 130, e.g., a printed circuit board, which has a first electrical connector 140. The slide 120 also has a locking member 200A, which in the exemplary embodiment is a snap mechanism, to lock part of a power/communication cable assembly to the slide 120.

Figures 6A, 6B:
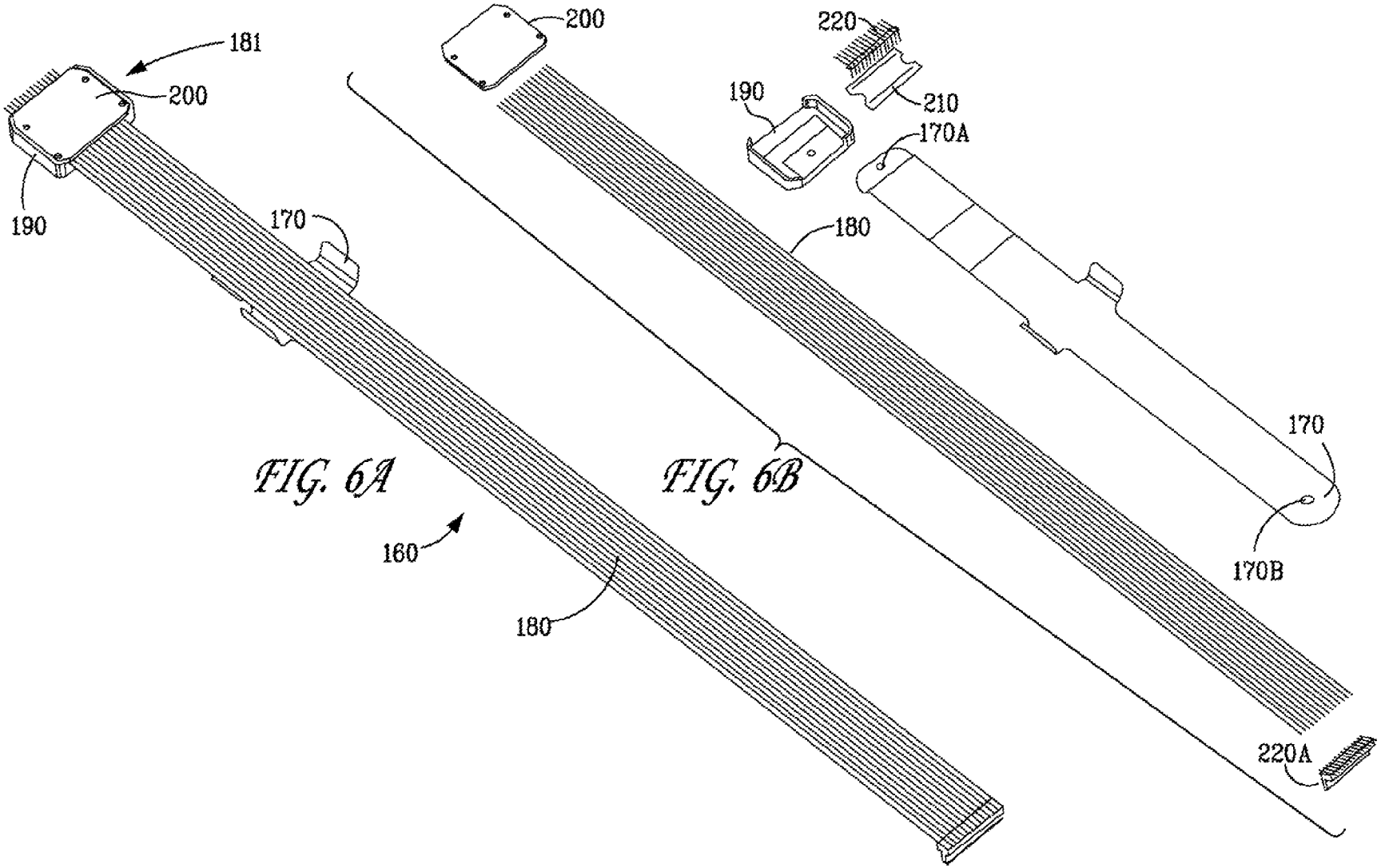
FIGS. 6A and 6B are perspective views, showing the elements of a cable assembly of the wiring assembly of FIG. 3 in assembled and unassembled stages.

Referring now to FIGS. 6A and 6B, the wiring assembly 100 also includes the cable assembly which includes cable 180 and housing 181. The housing 181 is comprised of a bottom 190, and a top 200 which is attached to the bottom 190 by, for example, screws. Other housing configurations are contemplated. The housing 181 encloses part of a second electrical connector 220. In the exemplary embodiment, the housing also encloses a second printed circuit board 210. In the exemplary embodiment, power/communication cable 180 is a ribbon cable of a predetermined length. Other wiring capable of power and/or data transmission could be similarly employed. Cable 180 is operatively coupled to the second electrical connector 220 by the second circuit board 210. The other end of the cable 180 has another electrical connector 220A for electrical connection to an electrical connector in the main body (not shown).

The cable 180 is supported by a guide 170. The guide 170 is attached to the housing 181 at a first point of attachment 170A. The guide 170 is attached to the main body 11 of the oven 10 at a second point of attachment 170B. In the exemplary embodiment, the guide 170 is a thin flat sheet of a metal material that is flexible, but stiffer than the cable 180. The guide 170 functions to anchor the cable 180 to the main body 11 of the oven 10.

The first electrical connector 140 is mated to the second electrical connector 220 such that opening of the access door 14 causes the slide 120 (carrying the first electrical connector 140) to translate from its first position to its second position. In the exemplary embodiment, the cable assembly is connected to the slide assembly as follows: The slide 120 is moved to its second position and held in that position by a locking member, such as a snap (not shown) on either the base 110 or the slide 120. The cable assembly is then operatively and firmly connected to the circuit board 130 by connecting the second electrical connector 220 to the first electrical connector 140 and by attaching the housing 181 to the slide 120 by the locking members 200A. After that, the locking member between the slide 120 and the base 110 is released. The tensioning member 150 then pulls the slide 120 back to its first position. This movement also causes part of cable 180 to move into the access door 14. Preferably, the length of cable 180 is selected such that cable 180 fully extends or is in tension when the slide 120 is in its first position. By this arrangement, when the access door 14 is opened, the base 110 moves away from the main body 11 of the oven 10. However, since the cable 180 is anchored to the main body 11 by the guide 170 and is extended to its full length or is in tension when the access door 14 is closed, the slide 120 is pulled to its second position from its first position by the cable 180 when the access door 14 is opening. When the access door 14 is closed, the base 110 moves closer to the main body 11 of the oven 10 and the tensioning member 150 pulls the slide 120 back to its first position. In this manner the access door 14 is allowed to sweep through an articulated motion without substantially stressing the cable 180.

Figure 7:
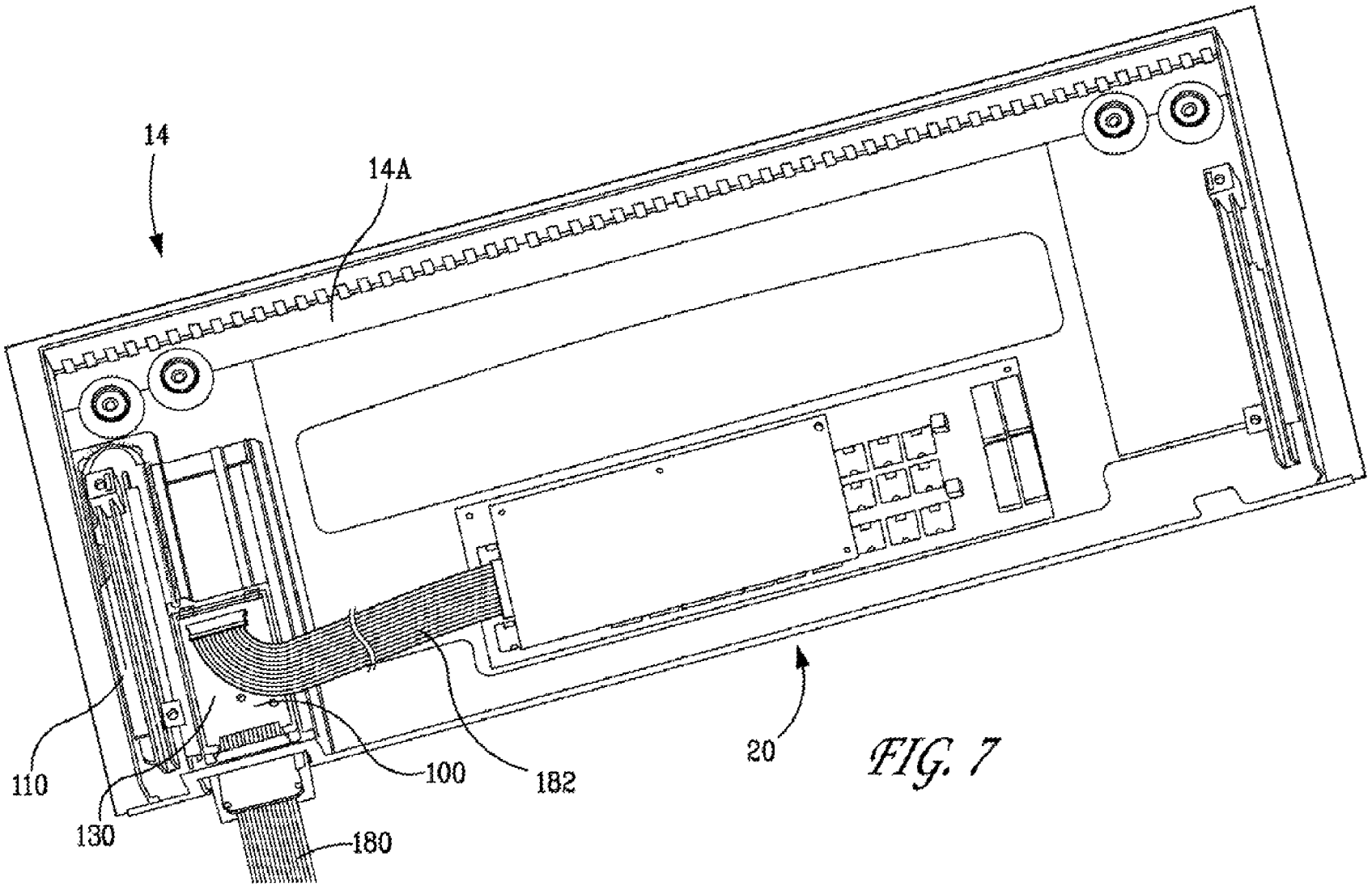
FIG. 7 is a perspective view, showing the door of FIG. 3 with the inner surface of the door being removed for clarity.

The circuit board 130 of the slide assembly has another electrical connector 230 by which the circuit board 130 is operatively connected to a second power/communication cable 182 which is operatively coupled to the HMI 20 in the access door 14 (see FIG. 7). An exemplary HMI is discussed in detail in the commonly owned application entitled "Human-Machine Interface Assembly for an Appliance", Ser. No. 12/329,036, filed Dec. 5, 2008, the entire content of which is incorporated herein by reference.

Thus, while there have shown and described and pointed out fundamental novel features of the invention as applied to an embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A wiring assembly for an appliance having a main body and a door movably attached to the main body, the wiring assembly comprising:

a base attachable to the door and comprising a first end and a second end;

a slide slidably mounted on the base so that the slide is moveable between a first position where the slide is adjacent to the first end and a second position where the slide is adjacent to the second end, the slide comprising a first electrical connector;

a biasing member biasing the slide to the first position; and a cable assembly comprising a power/communication cable attachable to the main body and connected to the slide, and a second electrical connector operatively connected to one end of the power/communication cable and to the first electrical connector.

2. The wiring assembly of claim 1, wherein the cable assembly further comprises a guide attachable to the main body, the power/communication cable being attached to the guide.

3. A wiring assembly for an appliance having a main body and a door movably attached to the main body by a hinge, the wiring assembly comprising:

a slide assembly comprising:

a base comprising a first end and a second end, the base being attached to the door;

a slide slidably mounted on the base so that the slide is moveable between a first position where the slide is adjacent to the first end and a second position where the slide is adjacent to the second end, the slide comprising a first circuit board; and a biasing member biasing the slide to the first position; and a cable assembly comprising a first power/communication cable attached to the main body and operatively connected to the first circuit board.

4. The wiring assembly of claim 3, wherein the first power/communication cable is a ribbon cable.

5. The wiring assembly of claim 3, wherein the first circuit board comprises a first electrical connector, the cable assembly further comprising a second electrical connector operatively connected to one end of the first power/communication cable and to the first electrical connector.

6. The wiring assembly of claim 5, wherein the first circuit board further comprises a third electrical connector operatively connectable to a second power/communication cable for a Human Machine Interface disposed in the door.

7. The wiring assembly of claim 5, wherein the cable assembly further comprises a second circuit board by which the second electric connector is operatively connected to the one end of the first power/communication cable, and a housing enclosing at least the second circuit board.

8. The wiring assembly of claim 7, wherein the cable assembly further comprises a guide attached to the main body and the housing, the first power/communication cable being supported by the guide.

9. The wiring assembly of claim 3, wherein the biasing member is a spring.

10. The wiring assembly of claim 3, wherein the base is disposed inside of the door.

11. An appliance comprising:

a main body defining a cavity therein;

a door movably attached to the main body by an articulating hinge for selectively covering the cavity, the door being pivotable about an edge thereof;

a Human Machine Interface disposed in the door;

a slide assembly comprising:

a base comprising a first end and a second end, the base being attached to the door so that the second end is closer to the edge of the door than the first end;

a slide slidably mounted on the base so that the slide is moveable between a first position where the slide is adjacent to the first end and a second position where the slide is adjacent to the second end, the slide comprising a first circuit board operatively connected to the Human Machine Interface; and a biasing member biasing the slide to the first position; and a cable assembly comprising a first power/communication cable attached to the main body and operatively connected to the first circuit board.

12. The appliance of claim 11, wherein the first circuit board comprises a first electrical connector, the cable assembly further comprising a second electrical connector operatively connected to one end of the first power/communication cable and to the first electrical connector.

13. The appliance of claim 12, wherein the cable assembly further comprises a second circuit board by which the second electric connector is operatively connected to the one end of the first power/communication cable.

14. The appliance of claim 13, wherein the cable assembly further comprises a housing enclosing at least the second circuit board.

15. The appliance of claim 14, wherein the slide further comprises a locking member for locking the housing to the slide.

16. The appliance of claim 14, wherein the cable assembly further comprises a guide attached to the main body and the housing, the power/communication cable being supported by the guide.

17. The appliance of claim 11, wherein the first power/communication cable is a ribbon cable.

18. The appliance of claim 11, wherein the biasing element is a tension spring.

19. The appliance of claim 11, wherein the appliance is an oven.

20. An appliance comprising:

a main body defining a cavity therein;

a door for selectively covering the cavity, the door being movably attached to the main body by an articulating hinge arrangement so that the door is movable between a closed position and an open position;

a Human Machine Interface disposed in the door;

a slide assembly comprising:

a base fixedly attached to the door; and a slide slidably mounted on the base for movement between a first position relatively close to the Human Machine Interface and relatively remote from the hinged edge of the door, and a second position relatively remote from the Human Machine Interface and relatively close to the hinged edge of the door;

a biasing member biasing the slide to the first position;

a cable assembly comprising a first power/communication cable, and a second power/communication cable; and a cable connector carried by the slide, wherein the first power/communication cable has a first end attached to the main body and a second end operatively connected to the cable connector and the second power/communication cable having a first end operatively connected to the cable connector and a second end operatively connected to the Human Machine Interface, the second ends of the first and second power/communication cables being operatively connected to each other by the cable connector, and wherein the first cable is operative to move the slide from the first position to the second position as the door moves from the closed position to the open position.

* * * * *